US009284137B2

(12) United States Patent
Sato

(10) Patent No.: US 9,284,137 B2
(45) Date of Patent: Mar. 15, 2016

(54) RECORDING SHEET STACKING TRAY

(71) Applicant: KONICA MINOLTA, INC., Chiyoda-ku, Tokyo (JP)

(72) Inventor: Ryuji Sato, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/663,397

(22) Filed: Mar. 19, 2015

(65) Prior Publication Data

US 2015/0266681 A1 Sep. 24, 2015

(30) Foreign Application Priority Data

Mar. 20, 2014 (JP) ..... 2014-058592

(51) Int. Cl.
*B65H 1/04* (2006.01)
*B65H 31/20* (2006.01)

(52) U.S. Cl.
CPC ..... *B65H 1/04* (2013.01); *B65H 31/20* (2013.01); *B65H 2405/1122* (2013.01); *B65H 2405/1124* (2013.01)

(58) Field of Classification Search
CPC .. B65H 31/20; B65H 1/04; B65H 2405/1122; B65H 2405/1124
USPC ..... 271/171, 213, 9.09
See application file for complete search history.

(56) References Cited

U.S. PATENT DOCUMENTS

| | | | | |
|---|---|---|---|---|
| 7,097,172 | B2 * | 8/2006 | Chang | 271/171 |
| 7,451,972 | B2 * | 11/2008 | Fukada et al. | 271/9.09 |
| 2009/0085279 | A1 * | 4/2009 | Wakakusa et al. | 271/145 |

FOREIGN PATENT DOCUMENTS

| | | | |
|---|---|---|---|
| JP | 06227679 | A | 8/1994 |
| JP | 2000016601 | A | 1/2000 |
| JP | 2006124147 | A | 5/2006 |
| JP | 2009154977 | A | 7/2009 |
| JP | 2012188233 | A | 10/2012 |

* cited by examiner

*Primary Examiner* — Michael McCullough
(74) *Attorney, Agent, or Firm* — Holtz, Holtz & Volek PC

(57) ABSTRACT

A recording sheet stacking tray stores a stack of recording sheets to be fed into an image forming apparatus. The recording sheet stacking tray includes a sheet feed tray main body, a sub-tray, and a trailing edge restriction member. The sheet feed tray main body has a first turning fulcrum extending perpendicular to a sheet feed direction of the recording sheets in a plan view. The sub-tray is attached to the sheet feed tray main body in such a manner that the sub-tray is turnable about the first turning fulcrum and extendable from the sheet feed tray main body. The trailing edge restriction member is attached to the sub-tray and restricts trailing edges of the recording sheets in the sheet feed direction.

7 Claims, 18 Drawing Sheets

RECORDING SHEET STACKING TRAY

CROSS-REFERENCE TO RELATED APPLICATIONS

The present application claims priority under 35 U.S.C. §119 to Japanese Patent Application No. 2014-058592, filed Mar. 20, 2014. The contents of this application are incorporated herein by reference in their entirety.

BACKGROUND OF THE INVENTION

1. Field of the Invention

The present invention relates to a recording sheet stacking tray.

2. Discussion of the Background

Recording sheets stacked on a recording sheet stacking tray are fed into the image forming apparatus. Conventionally, for this purpose, a sheet feeder is disposed on the downstream side of a sheet feed direction of the recording sheets. The sheet feeder includes a sheet feed roller and an elevating plate to upwardly press the recording sheets against the sheet feed roller. In this sheet feeder, when the elevating plate presses the recording sheets upwardly, the upper surface of the elevating plate is inclined downwardly to the upstream side of the sheet feed direction. Consequently, the recording sheets slip down the inclined surface of the elevating plate and move backwardly to the reverse side (upstream side) of the sheet feed direction. As a result, the recording sheets move away from the sheet feed roller, which may unfortunately cause a sheet feed error. Such a backward movement of recording sheets is frequently noticed in the case of recording sheets having a small size and high rigidity.

In order to prevent the above-described backward movement of recording sheets and stabilize the sheet feed operation, there exists a recording sheet stacking tray including a trailing edge restriction plate. The trailing edge restriction plate restricts trailing edges of the recording sheets stacked on the recording sheet stacking tray in accordance with a size of the recording sheets. For example, as disclosed in Japanese Unexamined Patent Application Publication No. 2012-188233, a groove in a sheet feed direction is formed in the recording sheet stacking tray in such a manner that the trailing edge restriction plate is movable in the sheet feed direction while being guided by the groove. As disclosed in Japanese Unexamined Patent Application Publication No. 2009-154977, another example of the recording sheet stacking tray includes an external trailing edge restriction plate detachably attached to insertion recessed portions in the recording sheet stacking tray corresponding to a plurality of sizes of recording sheets.

However, the trailing edge restriction plate, as disclosed in Japanese Unexamined Patent Application Publication No. 2012-188233, requires the groove to guide the trailing edge restriction plate formed in the upper surface of the recording sheet stacking tray. Therefore, the upper surface of the recording sheet stacking tray is not made flat. This may disadvantageously make unstable a stack state of the recording sheets. Moreover, a large stroke amount is necessary to slide the trailing edge restriction plate to a desired restriction position of the recording sheets. This may unfavorably degrade operability by a user.

An operation of the trailing edge restriction plate, as disclosed in Japanese Unexamined Patent Application Publication No. 2009-154977, involves labor and time. This is because each time recording sheets of a different size are used, the trailing edge restriction plate is detached from the insertion recessed portion and attached to another position. Furthermore, the recording sheet stacking tray has no place in which the trailing edge restriction plate is contained. Consequently, the trailing edge restriction plate, which is kept separately, may be unfortunately lost when not used.

The present invention has been made in view of the above-described problems. It is a technical object of the present invention to provide a recording sheet stacking tray including a trailing edge restriction member that is readily moved to a desired restriction position and contained in the recording sheet stacking tray while an upper surface of the recording sheet stacking tray is made flat.

SUMMARY OF THE INVENTION

According to one aspect of the present invention, a recording sheet stacking tray stores a stack of recording sheets to be fed into an image forming apparatus. The recording sheet stacking tray includes a sheet feed tray main body, a sub-tray, and a trailing edge restriction member. The sheet feed tray main body has a first turning fulcrum extending perpendicular to a sheet feed direction of the recording sheets in a plan view. The sub-tray is attached to the sheet feed tray main body in such a manner that the sub-tray is turnable about the first turning fulcrum and extendable from the sheet feed tray main body. The trailing edge restriction member is attached to the sub-tray and configured to restrict trailing edges of the recording sheets in the sheet feed direction.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
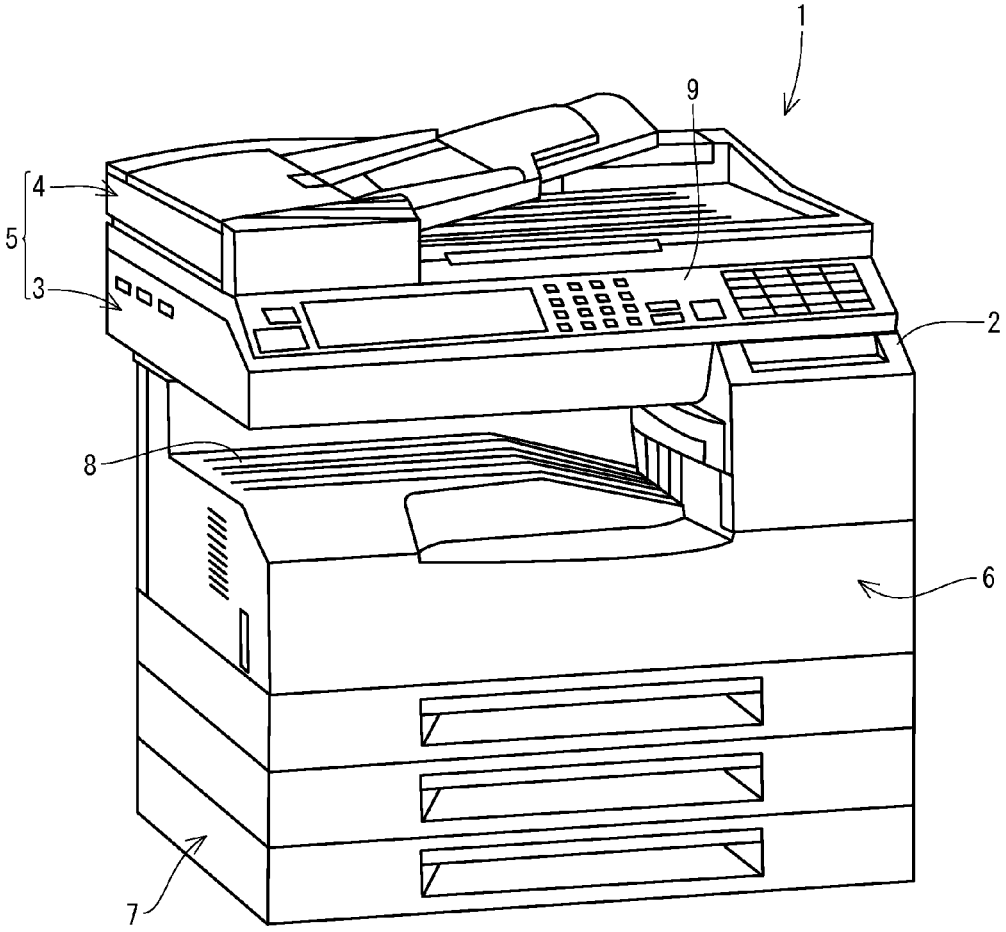
FIG. 1 is an external perspective view of a multifunctional peripheral.

The embodiments will now be described with reference to the accompanying drawings, wherein like reference numerals designate corresponding or identical elements throughout the various drawings.

(1) Outline of Image Forming Apparatus

A multifunctional peripheral 1 (hereinafter referred to as MFP) as an exemplary image forming apparatus is shown in FIG. 1. The MFP 1 has multiple functions of a copier, a scanner, a printer, and a facsimile. The MFP 1 transmits and receives data through a network (communication network) such as LAN and telephone lines. Specifically, the MFP 1 outputs image data read from a document to another computer through a network. In response to image data from another computer through a network, the MFP 1 executes printing based on the input image data. The MFP 1 transmits and receives FAX data.

An image reader 5 is disposed on an upper portion of an apparatus main body 2 of the MFP 1 and includes a scanner 3 and an automatic document feeder 4 (hereinafter referred to as ADF). The image reader 5 operates the scanner 3 and the ADF 4 in synchronism with each other and optically reads an image from each document set in the ADF 4 to acquire image data. Specifically, the ADF 4 feeds documents to the scanner 3 one by one. When each of the documents passes a predetermined reading position, the scanner 3 reads an image and acquires image data.

A sheet feeder 7 is disposed in a lower portion of the apparatus main body 2 and contains recording sheets P such as copying sheets. In the apparatus main body 2, an image formation unit 6 is disposed between the image reader 5 and the sheet feeder 7 and prints toner images on the recording sheets P. The sheet feeder 7 feeds the recording sheets P to the image formation unit 6 one by one. Based on image data acquired by the image reader 5 or through a network, the image formation unit 6 prints a toner image on each of the recording sheets P. In the apparatus main body 2, a recessed space between the image reader 5 and the image formation unit 6 serves as a sheet discharge reservoir 8. The recording sheet P on which the toner image has been printed by the image formation unit 6 is discharged to the sheet discharge reservoir 8.

On the front side of the apparatus main body 2, an operation panel 9 is disposed as setting means including a plurality of keys (buttons). A user operates the keys while checking, for example, a display of the operation panel 9. Thus, the user sets a function selected from various kinds of functions of the MFP 1 and instructs the MRP 1 to execute an operation.

(2) Configuration of Manual Sheet Feeder

Figure 2:
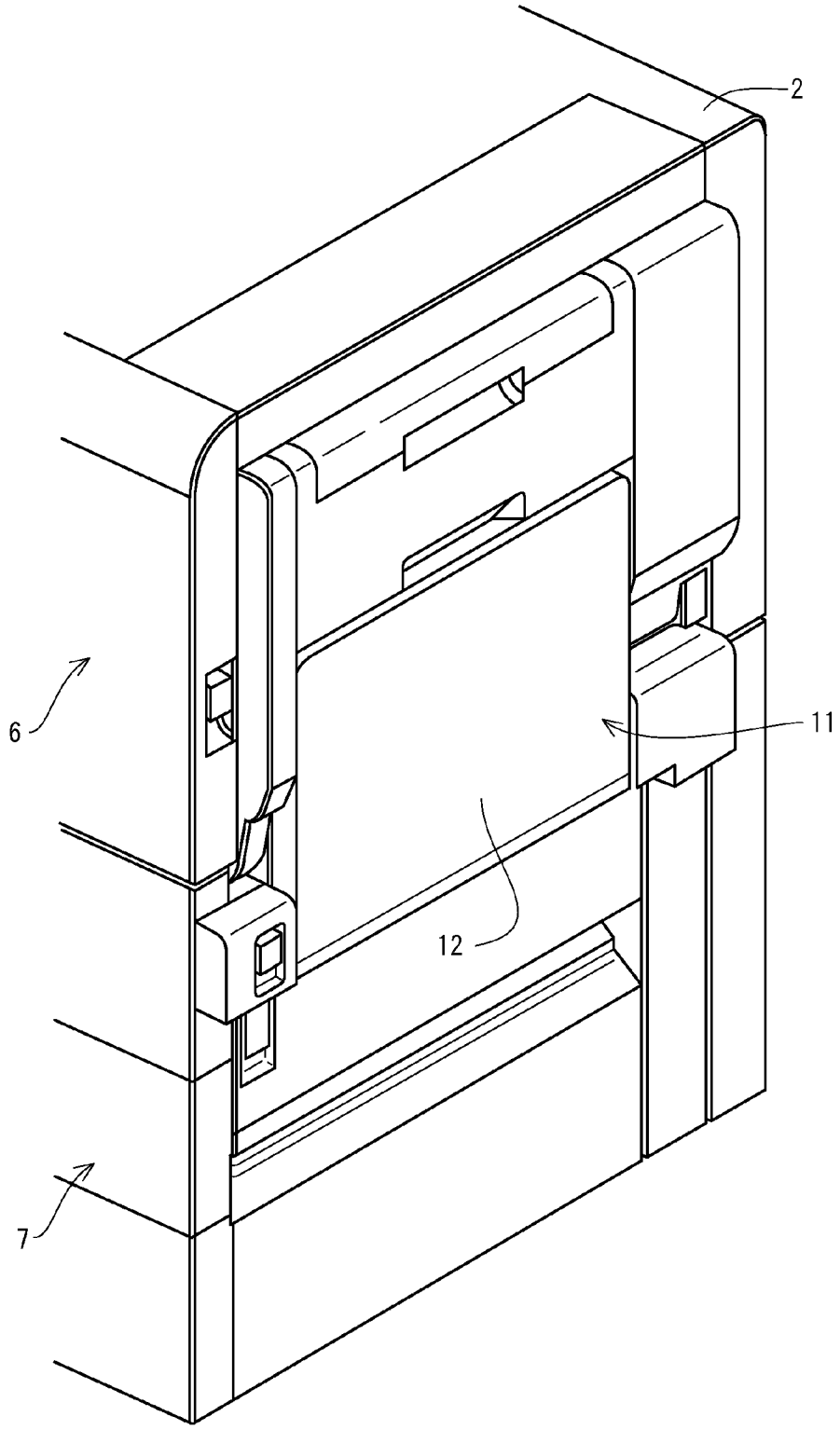
FIG. 2 is an enlarged perspective view of the multifunctional peripheral.
Figure 3:
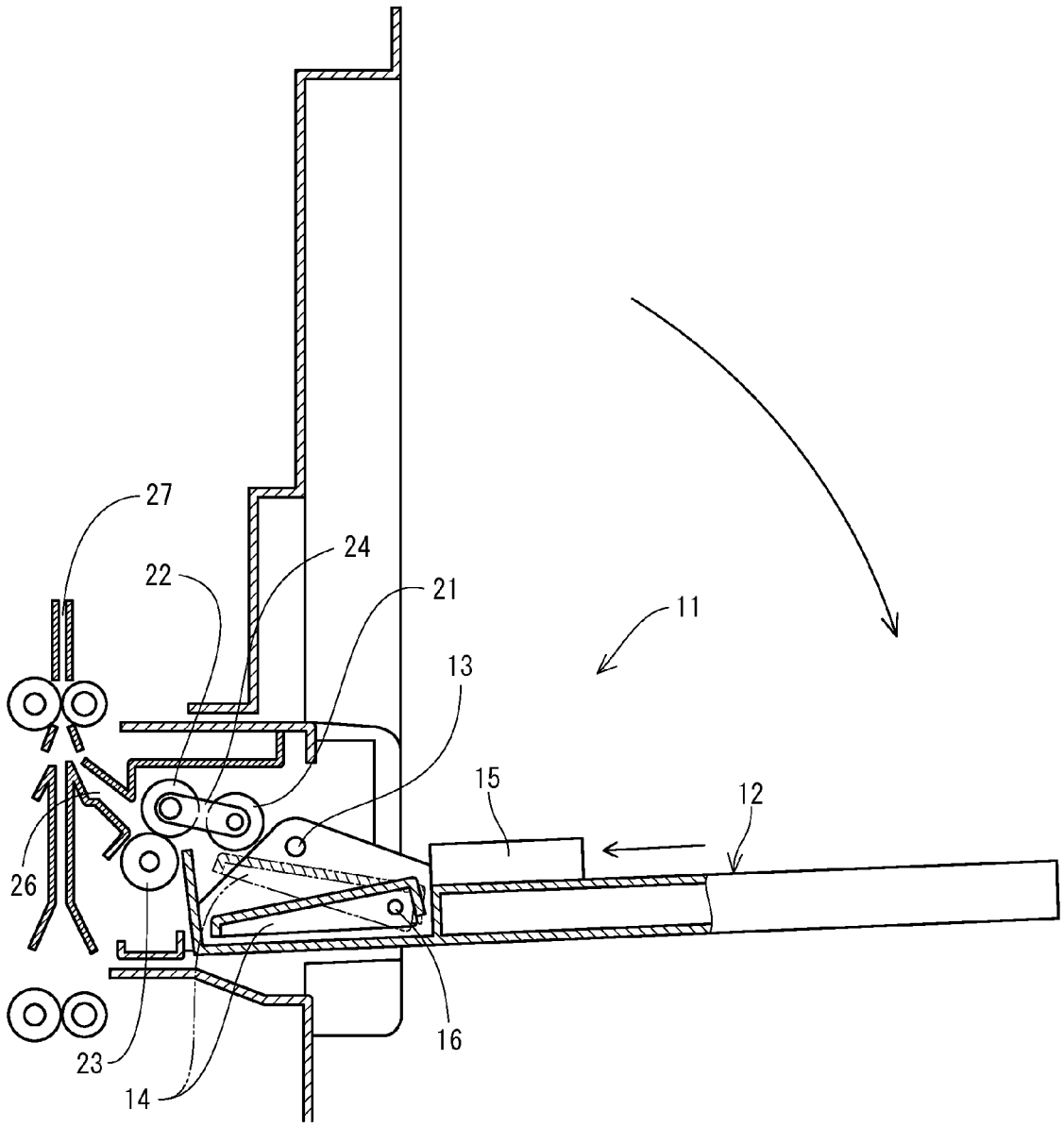
FIG. 3 is a side cross-sectional view of a manual sheet feeder.

Next, referring to FIGS. 2 and 3, description will be made on a configuration of a manual sheet feeder 11 as an exemplary sheet feeder. As shown in FIG. 2, on a side portion of the apparatus main body 2, the manual sheet feeder 11 is disposed to feed recording sheets P of a predetermined size from the outside. As an individual component separate from the normal sheet feeder 7 inside of the apparatus main body 2, the manual sheet feeder 11 is disposed on the side portion of the apparatus main body 2 in an auxiliary manner. The manual sheet feeder 11 includes a manual sheet feed tray 12 on which the recording sheets P are stacked. The manual sheet feed tray 12 is attached to the side portion of the apparatus main body 2 in such a manner that the manual sheet feed tray 12 is turnable and openable from the side portion. A pair of pivotal pins 13 (one of which is shown in FIG. 3) couple an end of the manual sheet feed tray 12 to the side portion of the apparatus main body 2. The manual sheet feed tray 12 is arranged to be vertically turnable about the pair of pivotal pins 13 as a fulcrum and openable from the side portion of the apparatus main body 2.

The manual sheet feed tray 12 includes an elevating plate 14 and a pair of side guide plates 15. The elevating plate 14 upwardly presses leading edges of the recording sheets P stacked on the manual sheet feed tray 12. The pair of side guide plates 15 guide the recording sheets P prior to sheet feed in a widthwise direction to align the center of the recording sheets P with a reference.

Through a pivotal shaft 16 on a proximal end of the elevating plate 14, the elevating plate 14 is vertically pivotally supported on the manual sheet feed tray 12. Only at the time of printing, the elevating plate 14 is turned upwardly by a transmission mechanism (not shown). When printing is ended, the elevating plate 14 returns to an original position. The transmission mechanism to turn the elevating plate 14 vertically may be a mechanism with a spring, a mechanism of combination of cam members and a drive motor, or a mechanism of combination of a drive motor and gear members.

Although not shown in detail, the pair of side guide plates 15 are arranged to be laterally movable in conjunction to be close to or away from each other. The recording sheets P stacked on the manual sheet feed tray 12 are held between the pair of side guide plates 15 and guided from both sides in the lateral direction. Consequently, the recording sheets P on the manual sheet feed tray 12 are set to have the center aligned with the reference irrespective of the standards of the recording sheets P.

On the apparatus main body 2 side, a pickup roller 21, a sheet feed roller 22, and a separation roller 23 are rotatably disposed. The pickup roller 21 draws out the recording sheets P stacked on the manual sheet feed tray 12 one by one. The sheet feed roller 22 is disposed on the downstream side of the pickup roller 21 in a conveyance direction of the recording sheets P. The separation roller 23 serves as a separation member to separate the recording sheets P in conjunction with the sheet feed roller 22. A proximal end portion of a coupling arm 24 is turnably attached to a shaft of the sheet feed roller 22. A shaft of the pickup roller 21 is rotatably supported to a distal end portion of the coupling arm 24. Consequently, through the coupling arm 24, the pickup roller 21 is supported to be vertically turnable (vertically swingable) about the shaft of the sheet feed roller 22.

The pickup roller 21 is opposed to the upper surface of the elevating plate 14. Although not shown, the coupling arm 24 is constantly urged downwardly by conventionally known urging means, for example, a spring, in such a manner that the pickup roller 21 is in contact with the recording sheets P on the manual sheet feed tray 12 under appropriate pressure. Consequently, leading edges of the recording sheets P on the manual sheet feed tray 12 are clamped between the elevating plate 14 and the pickup roller 21 vertically. The pickup roller 21 and the sheet feed roller 22 are rotated by a manual sheet feed motor (not shown) in common.

The separation roller 23 as the separation member is in contact with the sheet feed roller 22 from below. Predetermined torque is exerted on the separation roller 23 in a direction to hinder a sheet feed operation in order to prevent superposed conveyance of the recording sheets P (prevent two or more of the recording sheets P from being superposed and conveyed). A contact portion between the sheet feed roller 22 and the separation roller 23 serves as a sheet feed nip portion. It should be noted that the separation member should not be limited to the above-described separation roller 23 but may be a plate-shaped separation pad, for example. On the downstream side of the sheet feed roller 22 in the conveyance direction, a manual sheet feed path 26 is defined by guide members. The manual sheet feed path 26 communicates with a conveyance path 27 from the sheet feeder 7.

Recording sheets P are stacked on the manual sheet feed tray 12, and a printing button (not shown) of the MFP 1 is pressed down. Then, the manual sheet feed motor is driven to rotate the pickup roller 21 and the sheet feed roller 22. The elevating plate 14 presses the recording sheets P upwardly against the pickup roller 21. The pickup roller 21 is rotated to convey an uppermost recording sheet P to the sheet feed nip portion between the sheet feed roller 22 and the separation roller 23. When the recording sheet P reaches the sheet feed nip portion, the sheet feed roller 22 is rotated to convey the recording sheet P to the conveyance path 27 through the manual sheet feed path 26.

(3) Detailed Configuration of Manual Sheet Feed Tray

Next, referring to FIGS. 4 to 8, description will be made on a detailed configuration of the manual sheet feed tray 12 according to a first embodiment. The manual sheet feed tray 12 includes the elevating plate 14 and the pair of side guide plates 15, which have been described above, a sheet feed tray main body 31, a sub-tray 32, and a trailing edge restriction member 33. The sheet feed tray main body 31 includes a first turning fulcrum 31A extending perpendicular to a sheet feed direction of recording sheets P in a plan view. The sub-tray 32 is attached to the sheet feed tray main body 31 in such a manner that the sub-tray 32 is turnable about the first turning fulcrum 31A and extendable from the sheet feed tray main body 31. The trailing edge restriction member 33 is attached to the sub-tray 32 and restricts trailing edges of the recording sheets P in the sheet feed direction.

The sheet feed tray main body 31 is approximately rectangular in a plan view. The length (dimension in the sheet feed direction) of an upper surface of the sheet feed tray main body 31 is set to be slightly larger than a longitudinal dimension of A4 recording sheets P stacked longitudinally, that is, stacked to have the longer sides extend in the sheet feed direction. Thus, the recording sheets P do not protrude from an end portion of the sheet feed tray main body 31 on the upstream side of the sheet feed direction. The width (dimension perpendicular to the sheet feed direction) of the upper surface of the sheet feed tray main body 31 is set to be slightly larger than a widthwise dimension of SRA3 recording sheets P stacked longitudinally. Thus, the SRA3 recording sheets P are stacked on the sheet feed tray main body 31 longitudinally.

The sheet feed tray main body 31 includes a downstream stacking portion 34, a containing portion 35, and an upstream stacking portion 36. The downstream stacking portion 34 forms a recording sheet stacking surface on the upstream side of the pair of side guide plates 15 in the sheet feed direction. The containing portion 35, which has a U-shape in a plan view, is disposed on the upstream side of the downstream stacking portion 34 in the sheet feed direction. The containing portion 35 contains the sub-tray 32 and the trailing edge restriction member 33. The upstream stacking portion 36 is an area defined by the containing portion 35.

The downstream stacking portion 34 forms the recording sheet stacking surface on the upstream side of the elevating plate 14 and on the downstream side of the containing portion 35 in the sheet feed direction. An upper surface of the downstream stacking portion 34 is approximately flat. The width (dimension perpendicular to the sheet feed direction) of the upper surface of the downstream stacking portion 34 is set to be larger than the width of the containing portion 35.

In this embodiment, the containing portion 35 is a groove having a U-shape in a plan view formed in the upper surface of the sheet feed tray main body 31 on the upstream side of the sheet feed direction. The containing portion 35 defines an area on the upper surface of the sheet feed tray main body 31 on the upstream side of the sheet feed direction. The groove depth of the containing portion 35 is set to be approximately equal to the thickness of the sub-tray 32, which will be described later.

The upstream stacking portion 36 is formed on the area defined by the U-shaped containing portion 35 and has a rectangular insular shape in a plan view. The upper surface of the upstream stacking portion 36 and the upper surface of the downstream stacking portion 34 are on the same plane and function as the recording sheet stacking surface on both sides of the containing portion 35.

Figure 8:
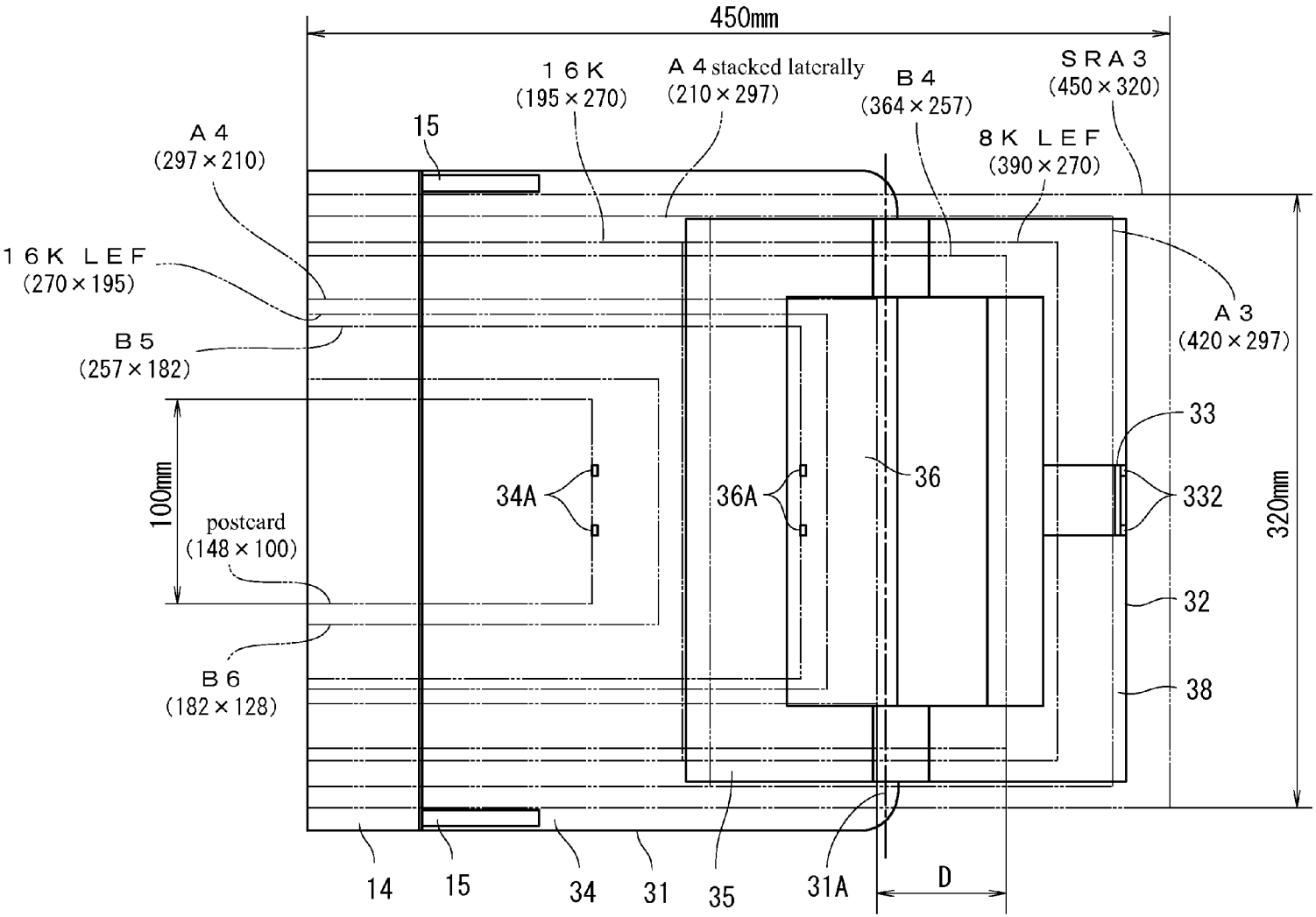
FIG. 8 is a plan view of the manual sheet feeder, illustrating a relationship between various sizes of recording sheets and a first turning fulcrum.

In the sheet feed tray main body 31 of this embodiment, first insertion holes 34A are formed in the upper surface of the downstream stacking portion 34 and correspond to protrusions 331 of the trailing edge restriction member 33, which will be described later. There are two first insertion holes 34A disposed side by side in the widthwise direction (direction perpendicular to the sheet feed direction) of the sheet feed tray main body 31. Second insertion holes 36A are formed in the upper surface of the upstream stacking portion 36. There are two second insertion holes 36A disposed side by side in the widthwise direction of the sheet feed tray main body 31. Preferably, the first insertion holes 34A and the second insertion holes 36A are arranged in such a manner that, when recording sheets P of predetermined sizes frequently used are set on the sheet feed tray main body 31, the first insertion holes 34A and the second insertion holes 36A are located at positions corresponding to trailing edges (upstream ends in the sheet feed direction) of the recording sheets P. In this embodiment, for example, as shown in FIG. 8, the first insertion holes 34A are located at positions corresponding to trailing edges of postcards stacked longitudinally (length: 148 mm) The second insertion holes 36A are located at positions corresponding to trailing edges of B5 sheets stacked longitudinally (length: 257 mm). The above-described locations of the first insertion holes 34A and the second insertion holes 36A should not be construed in a limiting sense. The first insertion holes 34A and the second insertion holes 36A may be located at other positions corresponding to sizes of recording sheets P frequently used in accordance with a use condition of the MFP 1.

The first turning fulcrum 31A of the sheet feed tray main body 31 is located away in the sheet feed direction from portions where positions of trailing edges of recording sheets P expected to be used concentrate. As a specific example, as shown in FIG. 8, the portions of concentration of the trailing edge positions are between trailing edges of postcards stacked longitudinally and trailing edges of A4 sheets stacked longitudinally and between trailing edges of B4 sheets stacked longitudinally and trailing edges of SRA3 sheets stacked longitudinally. In this case, a portion between the trailing edges of A4 sheets stacked longitudinally and the trailing edges of B4 sheets stacked longitudinally is a dead space D where trailing edges of recording sheets P frequently used are not located. The first turning fulcrum 31A in this embodiment is located in the dead space D.

The width of the upstream stacking portion 36 is set to be larger than widthwise dimensions of predetermined recording sheets P having trailing edges located in the range of the upstream stacking portion 36. Specifically, as shown in FIG. 8, A4 sheets stacked longitudinally, 16K sheets stacked laterally (LEF), and B5 sheets stacked longitudinally have trailing edges located in the range of the upstream stacking portion 36. The width of the upstream stacking portion 36 is set to be larger than the width of A4 sheets stacked longitudinally (210 mm), which is the largest width of these sizes.

The sub-tray 32 has the U-shape corresponding to the containing portion 35 in a plan view. The thickness of the sub-tray 32 is set to be equal to the groove depth of the containing portion 35. The sub-tray 32 is turnable about the first turning fulcrum 31A and extendable from the sheet feed tray main body 31.

Figure 4:
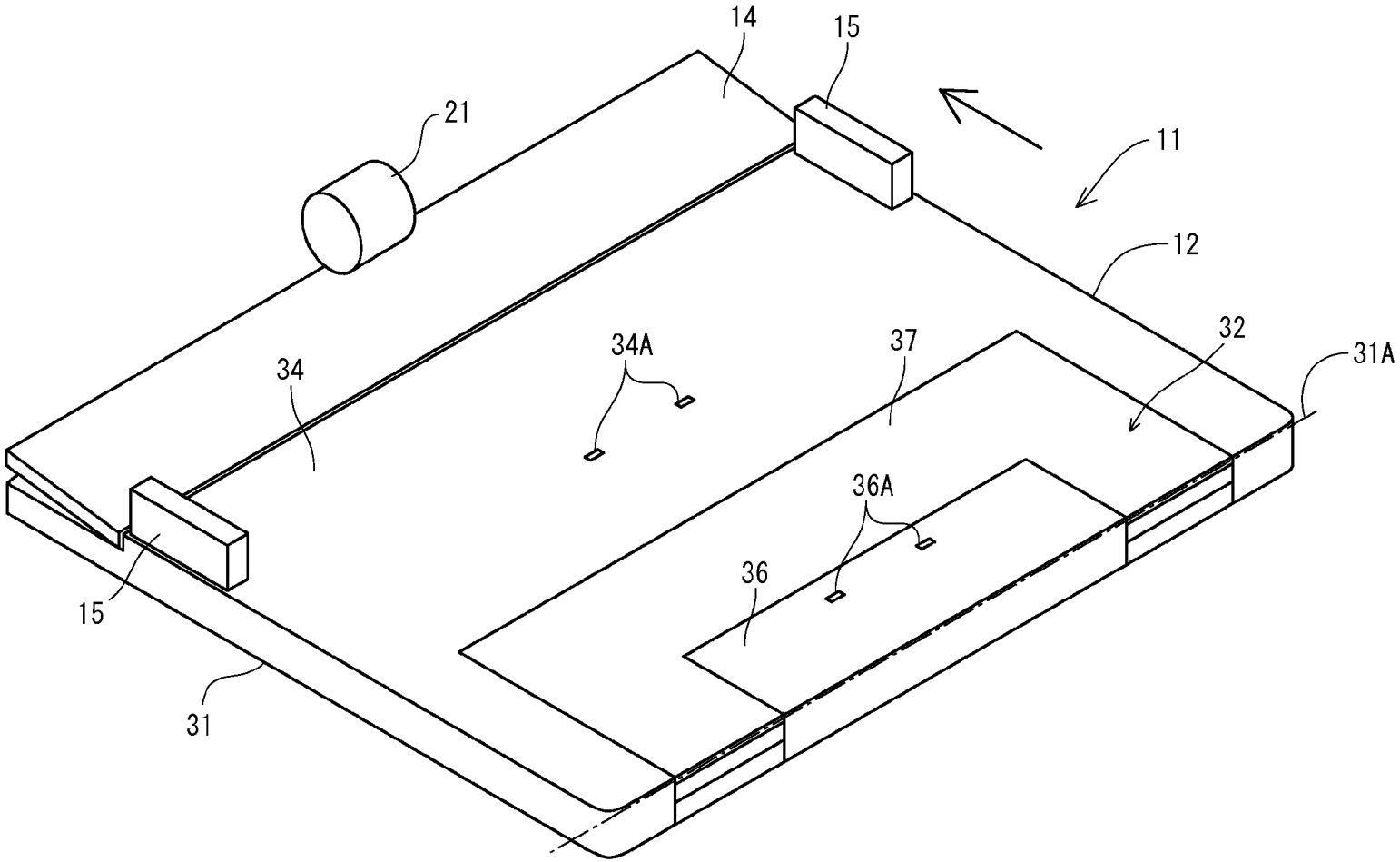
FIG. 4 is a perspective view of the manual sheet feeder, illustrating a contained state of a sub-tray.
Figure 5:
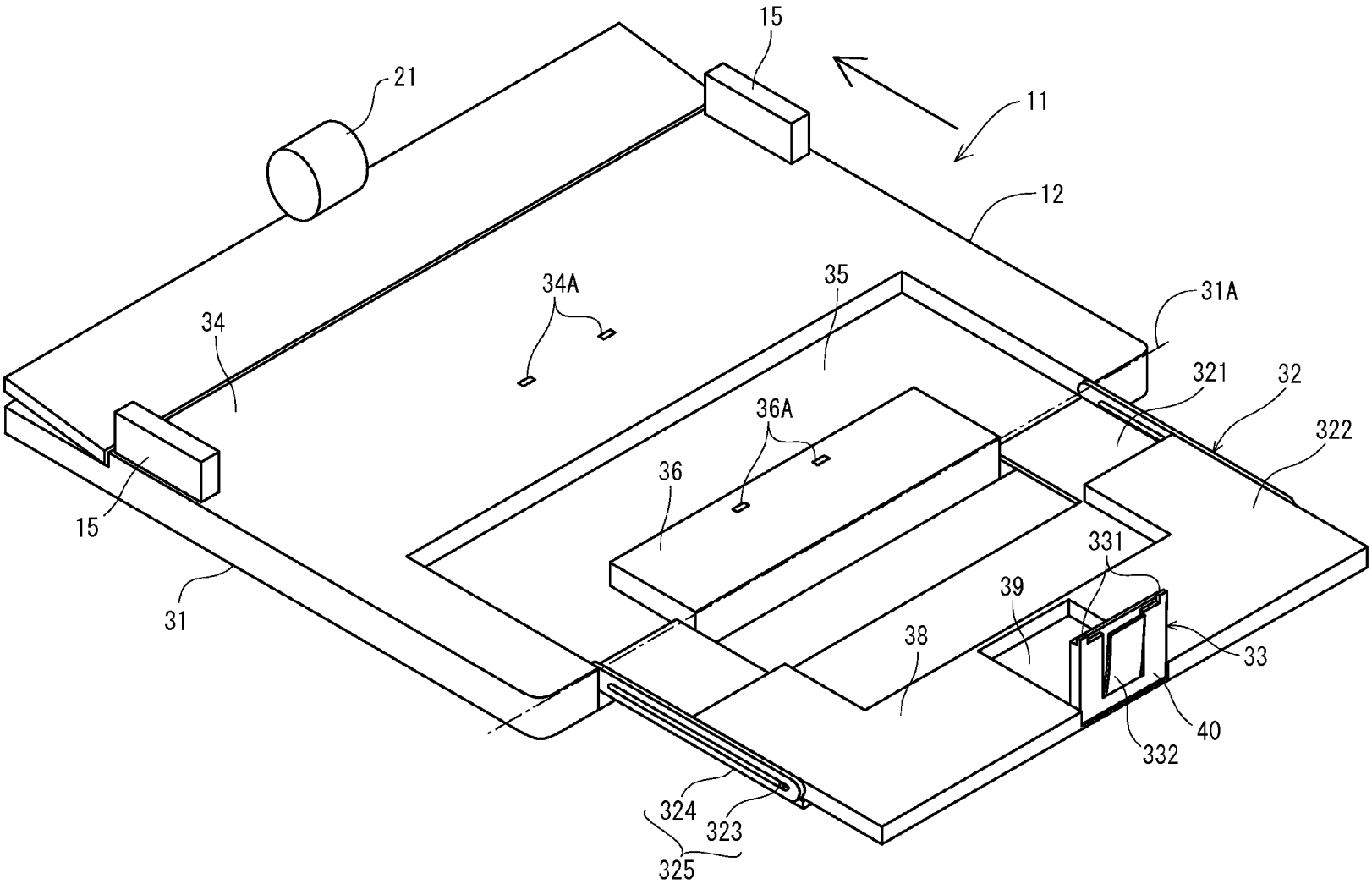
FIG. 5 is a perspective view of the manual sheet feeder, illustrating an extended state of the sub-tray.
Figure 6:
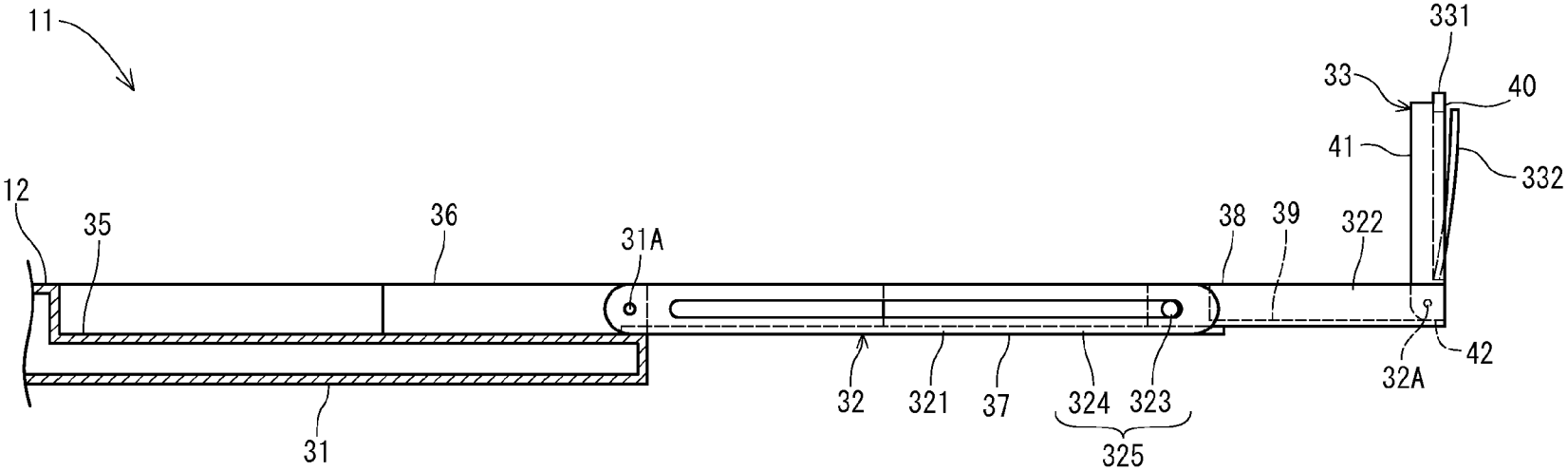
FIG. 6 is a cross-sectional view of the manual sheet feeder, illustrating the extended state of the sub-tray.

As shown in FIG. 4, in a contained state, the sub-tray 32 is folded and contained in the containing portion 35. An upper surface of the sub-tray 32 in this contained state is a contained-state upper surface 37 (lower surface in an extended state). The contained-state upper surface 37 of the sub-tray 32 is on the same plane as the upper surface of the downstream stacking portion 34 and the upper surface of the upstream stacking portion 36 and functions as the recording sheet stacking surface. As shown in FIGS. 5 and 6, the sub-tray 32 is turned by approximately 180° from the contained state. Specifically, the sub-tray 32 is turned and extended to a position where the sub-tray 32 is disposed approximately in parallel to the sheet feed tray main body 31 in the sheet feed direction. An upper surface of the sub-tray 32 in this extended state is an extended-state upper surface 38 (lower surface in the contained state). The extended-state upper surface 38 of the sub-tray 32 is on the same plane as the upper surface of the downstream stacking portion 34 and the upper surface of the upstream stacking portion 36 and functions as the recording sheet stacking surface.

The sub-tray 32 has a second turning fulcrum 32A extending perpendicular to the sheet feed direction of the recording sheets P in a plan view. In this embodiment, the second turning fulcrum 32A is located on the side of the sub-tray 32 that is opposite in the sheet feed direction to the side of the sub-tray 32 where the sub-tray 32 is attached to the sheet feed tray main body 31 (the first turning fulcrum 31A side).

The sub-tray 32 includes a first sub-tray 321 and a second sub-tray 322. The second sub-tray 322 is slidable relative to the first sub-tray 321 in the sheet feed direction. In this embodiment, as shown in FIGS. 5 and 6, pins 323 are secured to both end surfaces of the second sub-tray 322 in the widthwise direction. Guide members 324 are secured to both side end portions of the first sub-tray 321 in the widthwise direction. The guide members 324 have slots extending along the side end portions of the first sub-tray 321 in the widthwise direction (in a radial direction of the first turning fulcrum 31A). Through the slots, the guide members 324 guide the pins 323 along the side end portions of the first sub-tray 321 in the widthwise direction. The pins 323 and the guide members 324 constitute slider couplers 325. In this embodiment, no mechanism is provided for locking the pins 323 at predetermined positions. The second sub-tray 322 freely slides relative to the first sub-tray 321. The slider couplers 325 to couple the first sub-tray 321 and the second sub-tray 322 to each other will not be limited to a particular configuration. The slider couplers 325 may have a latch mechanism or a position restriction mechanism to lock the pins 323 at predetermined positions.

In this embodiment, as shown in FIGS. 5 and 6, the first sub-tray 321 and the second sub-tray 322 have a maximum extended state in which the pins 323 in the slots of the guide members 324 are slid to the farthest positions from the first turning fulcrum 31A. In this maximum extended state, the recording sheet stacking surface made up of the downstream stacking portion 34, the upstream stacking portion 36, and the extended-state upper surface 38 of the sub-tray 32 is the largest in the sheet feed direction. It should be noted that, as shown in FIG. 8, A3 sheets are stacked longitudinally (length: 420 mm) in the maximum extended state of this embodiment.

A containing portion 39 is formed in an approximately central portion of the second sub-tray 322 in the widthwise direction (direction perpendicular to the sheet feed direction) and contains the trailing edge restriction member 33, which will be described later. The containing portion 39 is an approximately rectangular recessed portion in a plan view. In this embodiment, the depth of the containing portion 39 is set to be approximately equal to the thickness of the trailing edge restriction member 33. However, the depth of the containing portion 39 may be larger than the thickness of the trailing edge restriction member 33. Further, the containing portion 39 may penetrate the second sub-tray 322 in the thickness direction, that is, the containing portion 39 may be a rectangular opening in a plan view.

The trailing edge restriction member 33 has an approximately rectangular shape corresponding to the containing portion 39, and is set to have a thickness equal to or less than the groove depth of the containing portion 39. The trailing edge restriction member 33 is attached to the sub-tray 32 in such a manner that the trailing edge restriction member 33 is turned about the second turning fulcrum 32A to be extendable from the sub-tray 32. More specifically, the trailing edge restriction member 33 is arranged to be extendable from the second sub-tray 322.

In this embodiment, in a contained state, the trailing edge restriction member 33 is folded and contained in the containing portion 39. A first restriction surface 40, which is an upper surface of the trailing edge restriction member 33 in this contained state, is arranged to be on the same plane as the extended-state upper surface 38 of the sub-tray 32. In the extended state of the sub-tray 32, the first restriction surface 40 may function as a part of the recording sheet stacking surface. Also, in the extended state of the sub-tray 32, as shown in FIGS. 5 and 6, the trailing edge restriction member 33 is turned by approximately 90° from the contained state. That is, the trailing edge restriction member 33 is extended to such a position that the first restriction surface 40 of the trailing edge restriction member 33 is approximately perpendicular to the extended-state upper surface 38 of the sub-tray 32. In this case, the first restriction surface 40 of the trailing edge restriction member 33 faces the upstream side of the sheet feed direction. A second restriction surface 41, which is on the side of the trailing edge restriction member 33 that is opposite to the first restriction surface 40 side, faces the downstream side of the sheet feed direction (the apparatus main body 2 side). The second restriction surface 41 facing the downstream side of the sheet feed direction (the apparatus main body 2 side) functions as a trailing edge restriction surface of the trailing edge restriction member 33. When the trailing edge restriction member 33 is turned by approximately 90° from the contained state, a contact surface 42, which is a lower surface of the trailing edge restriction member 33, is brought into contact with an upper surface of the containing portion 39 of the second sub-tray 322. Due to friction between these surfaces in contact with each other, the trailing edge restriction member 33 is secured. This configuration for securing the trailing edge restriction member 33 should not be construed in a limiting sense. An individual mechanism may be provided for securing the trailing edge restriction member 33.

Figure 7:
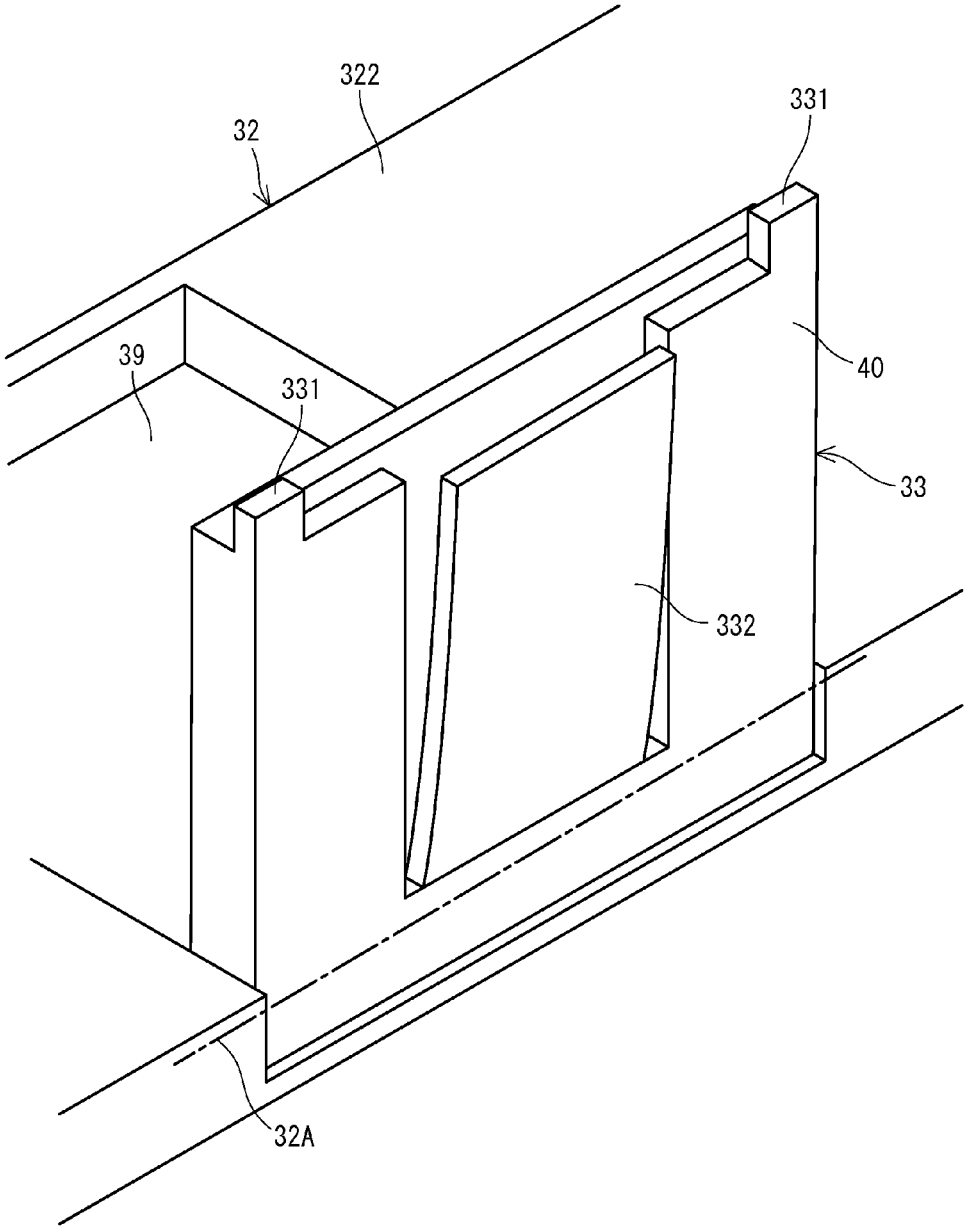
FIG. 7 is an enlarged perspective view of a trailing edge restriction member.

As shown in FIG. 7, protrusions 331 are formed on an upper end of the trailing edge restriction member 33 turned by approximately 90° from the contained state. The protrusions 331 correspond to the first insertion holes 34A and the second insertion holes 36A of the sheet feed tray main body 31. The protrusions 331 are located closer to the first restriction surface 40 side. Specifically, when the trailing edge restriction member 33 is turned by approximately 90° from the contained state, the surfaces of the protrusions 331 that face the upstream side of the sheet feed direction are arranged to be on the same plane as the first restriction surface 40. The trailing edge restriction member 33 further includes an elastic member 332 disposed on the first restriction surface 40 side. The elastic member 332 is of a plate bent to protrude outwardly from the first restriction surface 40 in a side view.

As shown in FIGS. 5 and 6, the first sub-tray 321 and the second sub-tray 322 are in the maximum extended state, and the trailing edge restriction member 33 is turned by approximately 90° from the contained state. Of the recording sheets P of predetermined sizes frequently used, recording sheets P having a large length are set on the sheet feed tray main body 31. In this case, preferably, the second restriction surface 41 is located at a position corresponding to trailing edges of the recording sheets P (upstream ends in the sheet feed direction).

In the configuration of the first embodiment, the sub-tray 32 and the trailing edge restriction member 33 attached to the sub-tray 32 are turned about the first turning fulcrum 31A and extended from the sheet feed tray main body 31. In addition, the second sub-tray 322 constituting the sub-tray 32 is slidable along the side end portions of the first sub-tray 321 in the widthwise direction. Consequently, the trailing edge restriction member 33 is readily moved to a desired restriction position. Moreover, the sub-tray 32 is folded and contained in the containing portion 35 of the sheet feed tray main body 31. The trailing edge restriction member 33 is folded and contained in the containing portion 39 of the sub-tray 32. Thus, the sub-tray 32 and the trailing edge restriction member 33 are folded without obstacles and kept in reduced space. Also, the trailing edge restriction member 33 is prevented from being lost, and this facilitates keeping the trailing edge restriction member 33.

The sub-tray 32 has the second turning fulcrum 32A extending perpendicular to the sheet feed direction of the recording sheets P in a plan view. The trailing edge restriction member 33 is turnable about the second turning fulcrum 32A. Consequently, the trailing edge restriction member 33 is merely turned to make the trailing edge restriction member 33 implement a function for restricting the trailing edges of the recording sheets P. Therefore, no troublesome operation is required, and this improves operability of the user.

Figure 9:
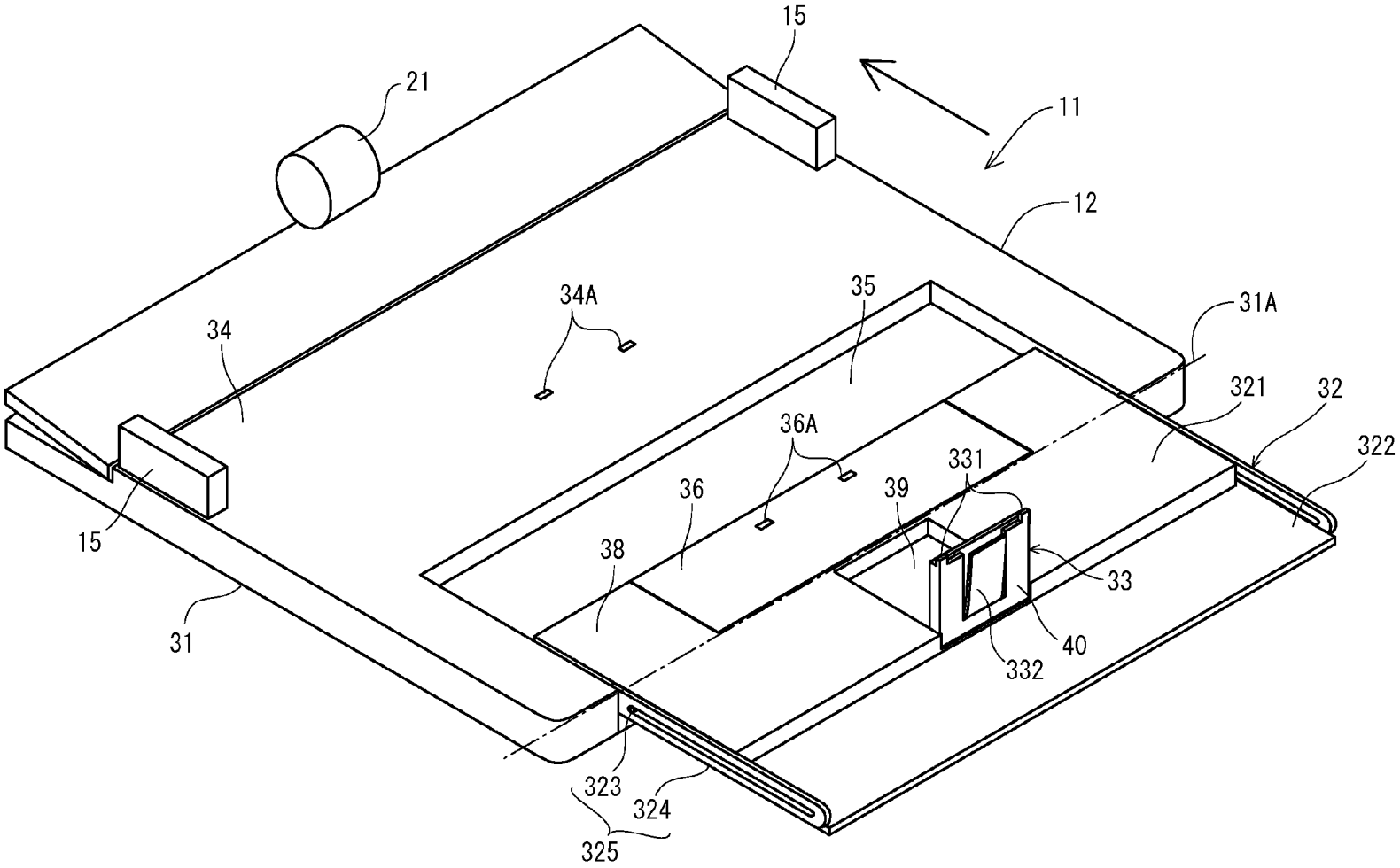
FIG. 9 is a perspective view of the manual sheet feeder, illustrating an extended state of a sub-tray according to a first modification.
Figure 10:
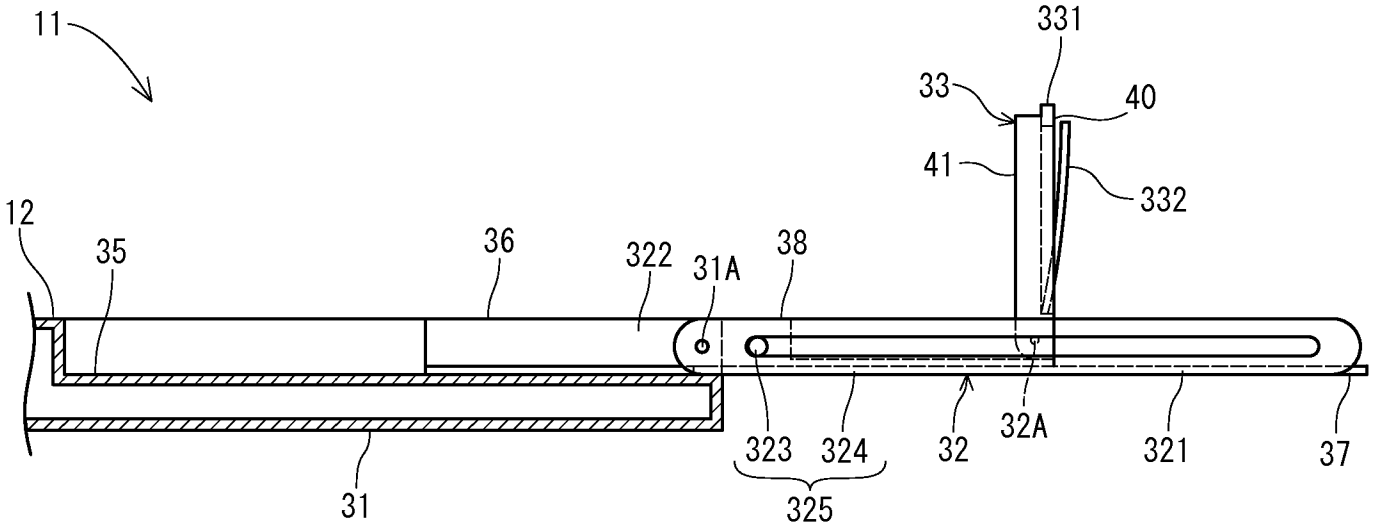
FIG. 10 is a cross-sectional view of the manual sheet feeder, illustrating the extended state of the sub-tray according to the first modification.

With the above-described manual sheet feed tray 12, as in a first modification shown in FIGS. 9 and 10, when the sub-tray 32 is turned by approximately 180° from the contained state (in the extended state), the pins 323 in the slots of the guide members 324 are slidable to the closest position to the first turning fulcrum 31A. That is, the second sub-tray 322 is slidable to the downstream side of the sheet feed direction and closer to the first turning fulcrum 31A. For example, the second sub-tray 322 is slid to a second extended state in which the second sub-tray 322 is at the closest position to the first turning fulcrum 31A. In this second extended state, a partial end surface of the second sub-tray 322 on the downstream side of the sheet feed direction and a partial or whole end surface of the upstream stacking portion 36 on the upstream side of the sheet feed direction are in contact with each other in the sheet feed direction. As shown in FIG. 8, trailing edges of 8K sheets stacked laterally (LEF) and B4 sheets stacked longitudinally are located in a slidable area of the second sub-tray 322. Consequently, the second sub-tray 322 is slidable in such a manner that the second restriction surface 41 is at positions corresponding to the trailing edges of the sheets of these sizes.

Figure 11:
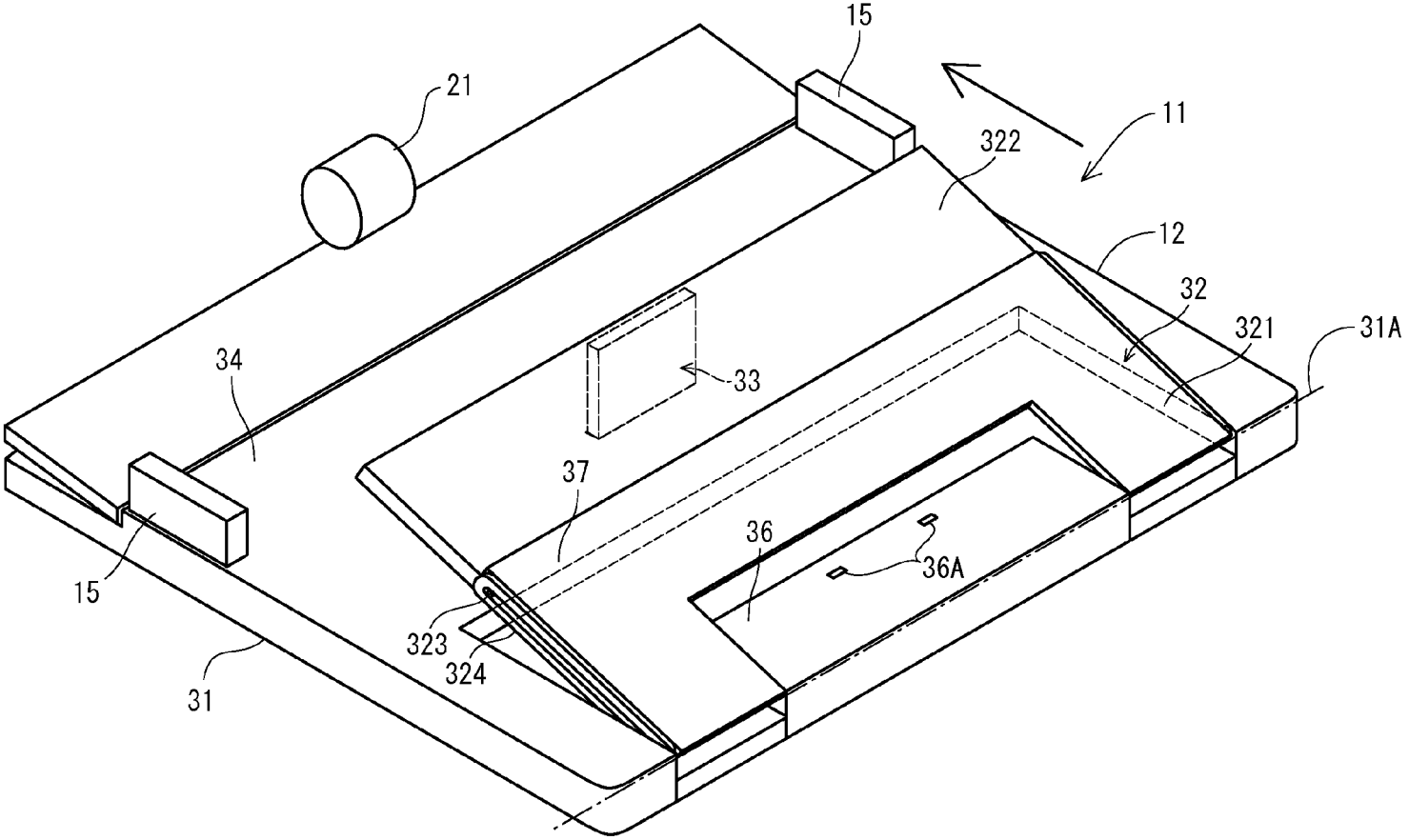
FIG. 11 is a perspective view of the manual sheet feeder, illustrating an extended state of a sub-tray according to a second modification.
Figure 12:
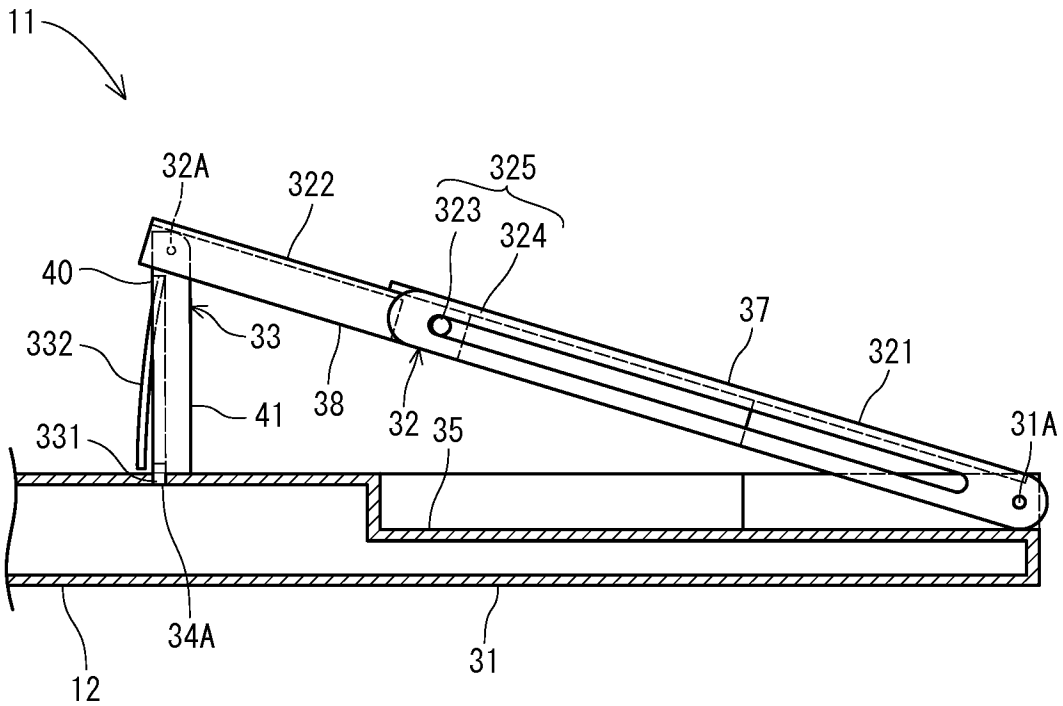
FIG. 12 is a cross-sectional view of the manual sheet feeder, illustrating the extended state of the sub-tray according to the second modification.

With the above-described manual sheet feed tray 12, as in a second modification shown in FIGS. 11 and 12, when the sub-tray 32 is upwardly turned by 20° to 30° from the contained state, the pins 323 in the slots of the guide members 324 are located far from the first turning fulcrum 31A. That is, the second sub-tray 322 is changed to a third extended state in which the second sub-tray 322 is slid to the downstream side of the sheet feed direction and closer to the first turning fulcrum 31A. In the third extended state, the protrusions 331 of the trailing edge restriction member 33 are inserted and secured in the first insertion holes 34A. In this third extended state, the first restriction surface 40 of the trailing edge restriction member 33 and the elastic member 332 face the downstream side of the sheet feed direction (the apparatus main body 2 side). In particular, the elastic member 332 protrudes more to the downstream side of the sheet feed direction than the first restriction surface 40. Consequently, the elastic member 332 is in contact with the trailing edges of the recording sheets P. The third extended state corresponds to recording sheets P of small sizes. In this embodiment, since the first insertion holes 34A are at the positions corresponding to postcards stacked longitudinally, the third extended state corresponds to trailing edges of postcards stacked longitudinally. In the third extended state, the elastic member 332, which is in contact with the trailing edges of the recording sheets P, restricts the position of the trailing edges of the recording sheets P. Moreover, the elastic member 332 presses the trailing edges of the recording sheets P to the downstream side of the sheet feed direction, thus preventing the recording sheets P from moving backwardly.

Figure 13:
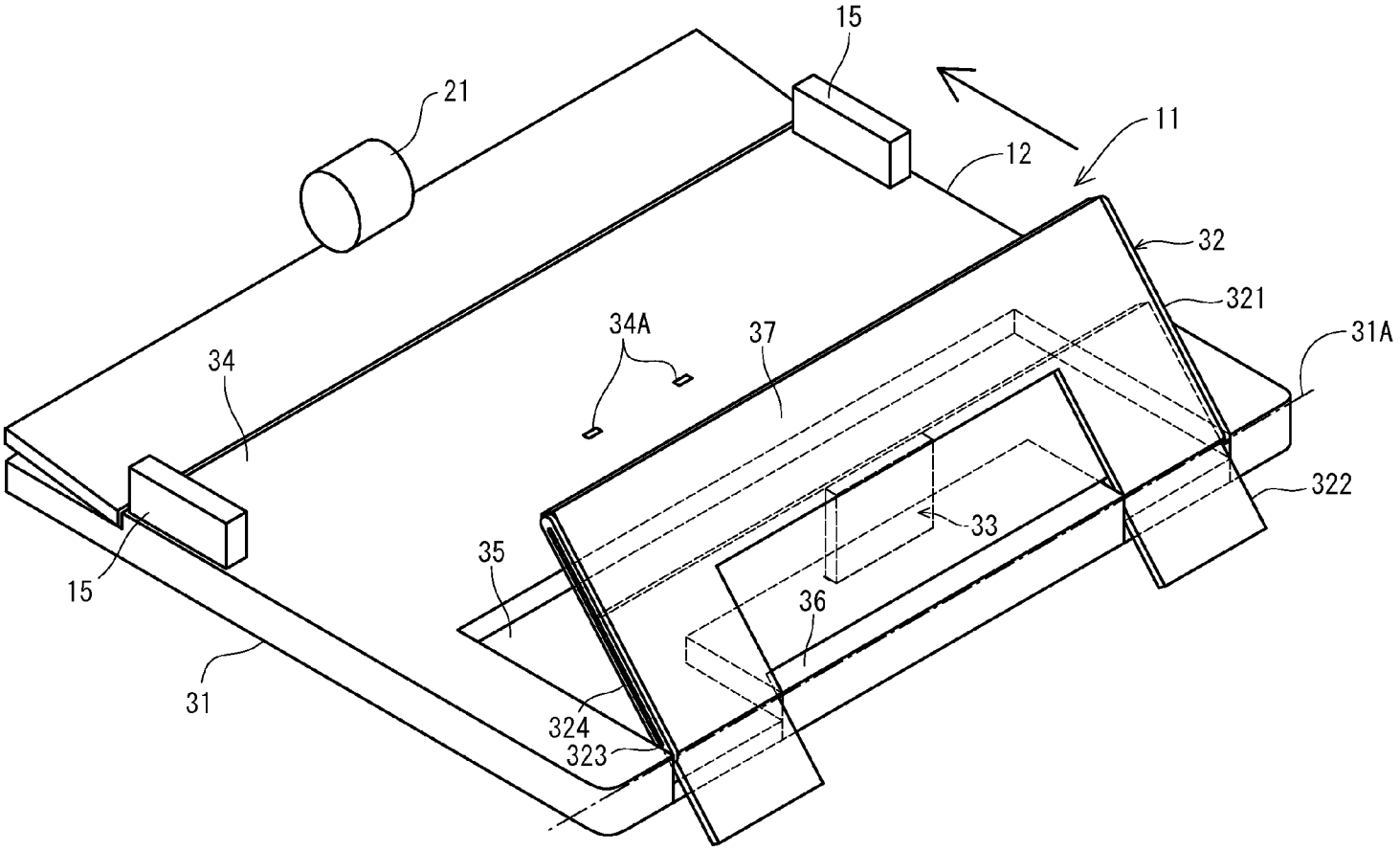
FIG. 13 is a perspective view of the manual sheet feeder, illustrating an extended state of a sub-tray according to a third modification.
Figure 14:
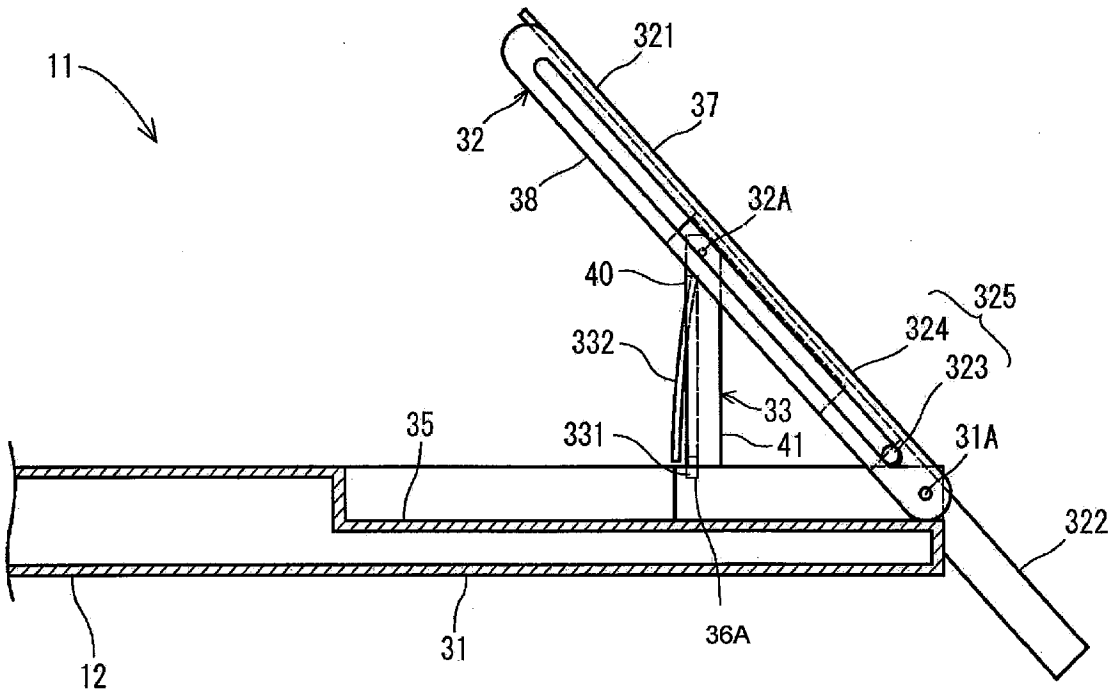
FIG. 14 is a cross-sectional view of the manual sheet feeder, illustrating the extended state of the sub-tray according to the third modification.

With the above-described manual sheet feed tray 12, as in a third modification shown in FIGS. 13 and 14, when the sub-tray 32 is turned by 40° to 50° from the contained state, the pins 323 in the slots of the guide members 324 are located close to the first turning fulcrum 31A. That is, the second sub-tray 322 is changed to a fourth extended state in which the second sub-tray 322 is slid to the downstream side of the sheet feed direction and closer to the first turning fulcrum 31A. In the fourth extended state, similarly to the third extended state, the first restriction surface 40 of the trailing edge restriction member 33 and the elastic member 332 face the downstream side of the sheet feed direction (the apparatus main body 2 side). The elastic member 332 protrudes more to the downstream side of the sheet feed direction than the first restriction surface 40. Consequently, the elastic member 332 is in contact with the trailing edges of the recording sheets P. In the fourth extended state, the protrusions 331 of the trailing edge restriction member 33 are inserted and secured in the second insertion holes 36A. The fourth extended state corresponds to recording sheets P of intermediate sizes between the sizes to which the second extended state and the third extended state correspond. In this embodiment, since the second insertion holes 36A are at the positions corresponding to B5 sheets stacked longitudinally, as described above, the fourth extended state corresponds to trailing edges of B5 sheets stacked longitudinally. In the fourth extended state, similarly to the third extended state, the elastic member 332, which is in contact with the trailing edges of the recording sheets P, restricts the position of the trailing edges of the recording sheets P. Moreover, the elastic member 332 presses the trailing edges of the recording sheets P to the downstream side of the sheet feed direction, thus preventing the recording sheets P from moving backwardly.

(4) Others

Figure 15:
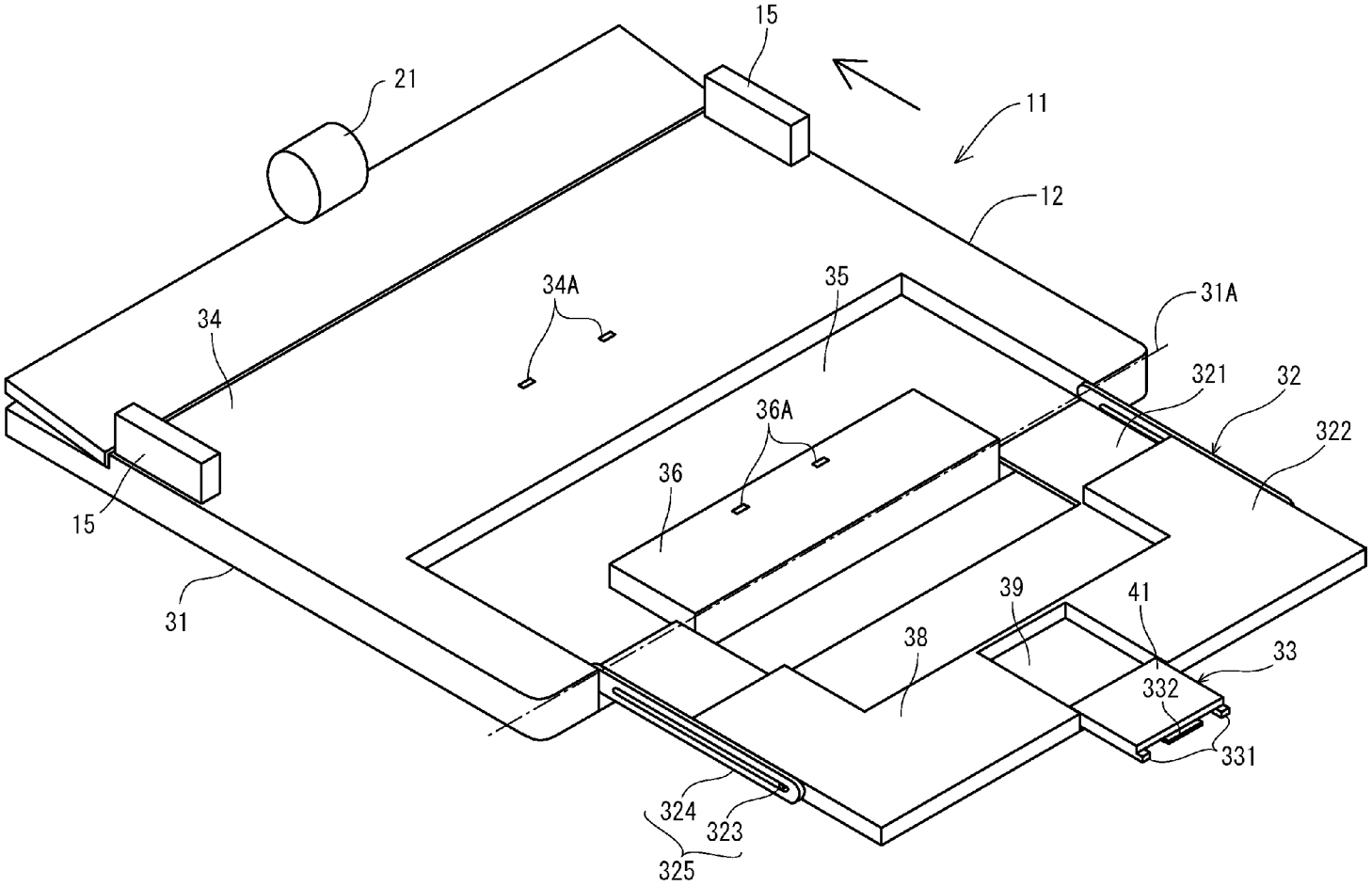
FIG. 15 is a perspective view of the manual sheet feeder, illustrating an extended state of a sub-tray according to a fourth modification.
Figure 16:
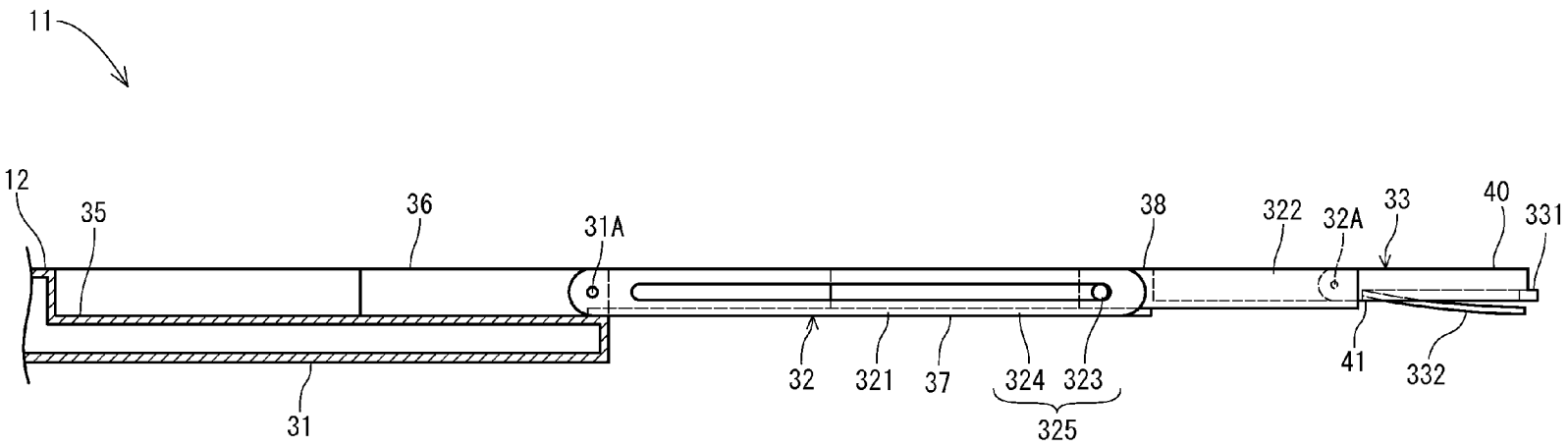
FIG. 16 is a cross-sectional view of the manual sheet feeder, illustrating the extended state of the sub-tray according to the fourth modification.

The present invention will not be limited to the above-described embodiment but may be modified in various manners. For example, the multifunctional peripheral has been described as an example of the image forming apparatus. However, the image forming apparatus may be a printer, a copying machine, or a facsimile. Moreover, as shown in FIGS. 15 and 16, the trailing edge restriction member 33 may be turned by approximately 180° from the contained state, that is, turned and extended to a position approximately in parallel to the sub-tray 32 in the sheet feed direction. In this case, when the second restriction surface 41 of the trailing edge restriction member 33 is on the same plane as the extended-state upper surface 38 of the sub-tray 32, the second restriction surface 41 functions as a part of the recording sheet stacking surface.

Figure 17:
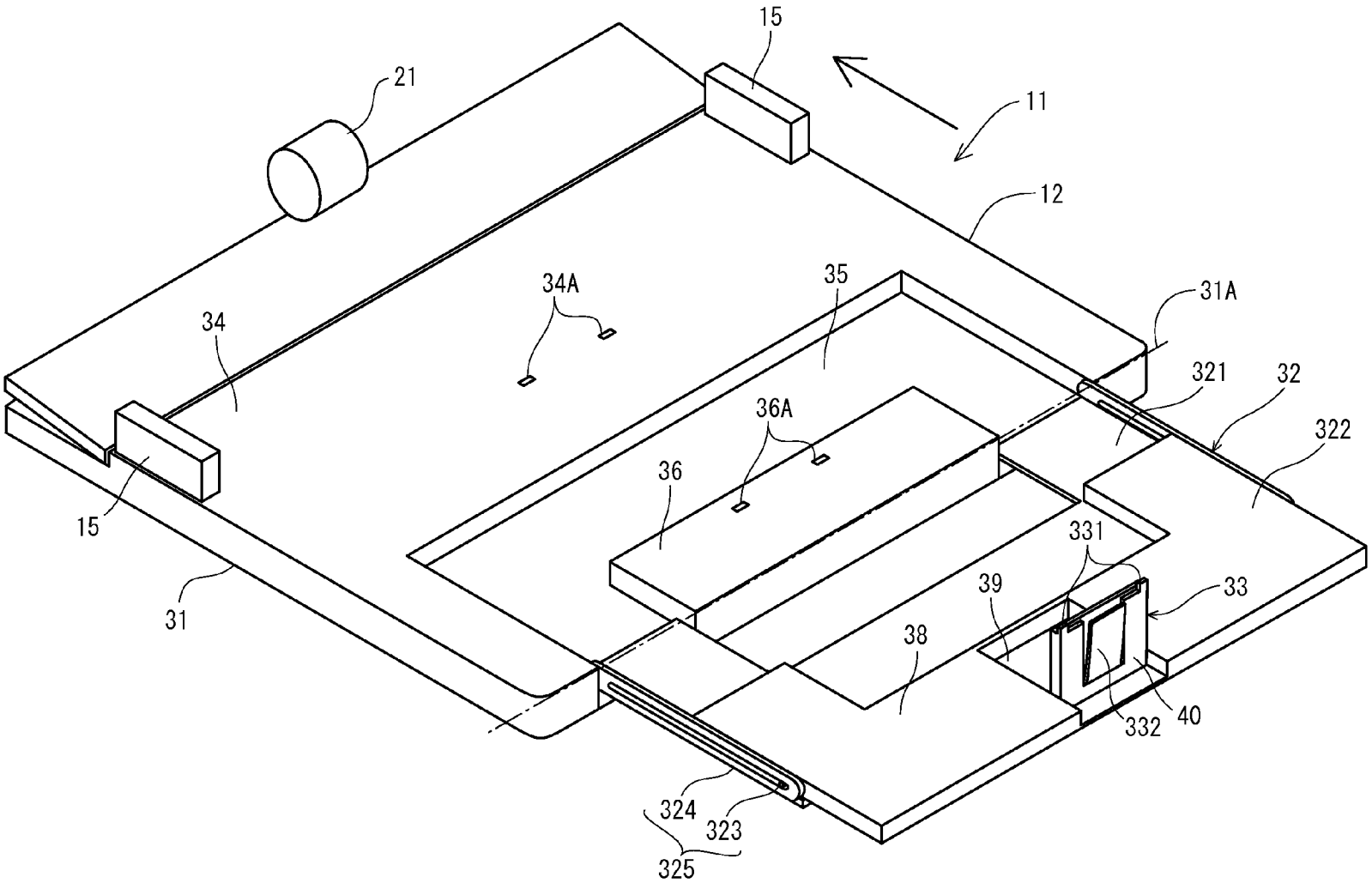
FIG. 17 is a perspective view of the manual sheet feeder, illustrating an extended state of a sub-tray according to a fifth modification.

As shown in FIG. 17, the trailing edge restriction member 33 may be made slidable in the sheet feed direction when the sub-tray 32 is in the extended state. Further, a multistage angle restriction mechanism may be provided for restricting the trailing edge restriction member 33 at predetermined angles when the trailing edge restriction member 33 is turned about the second turning fulcrum 32A.

Figure 18:
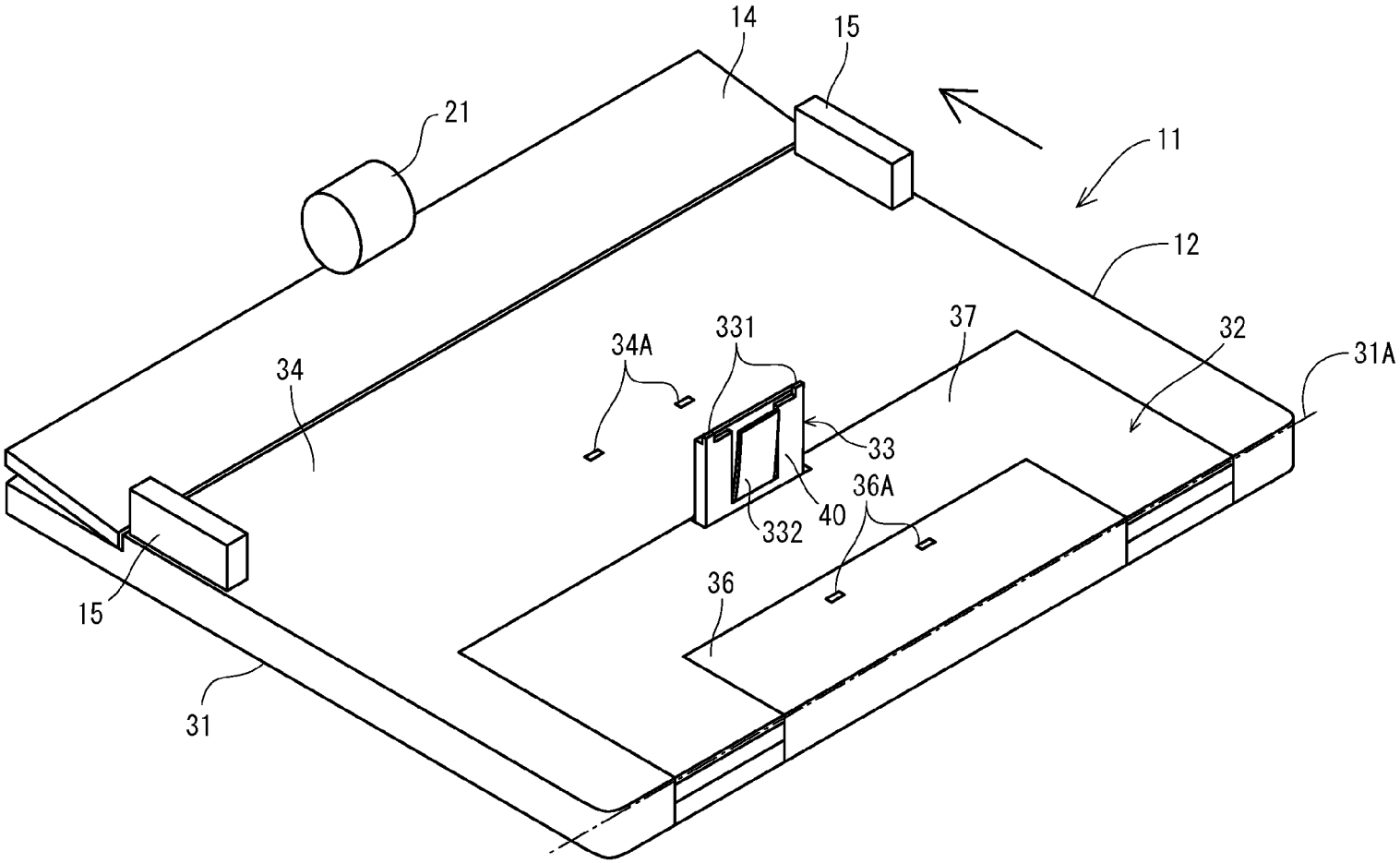
FIG. 18 is a perspective view of the manual sheet feeder, illustrating an extended state of a sub-tray according to a sixth modification.

As shown in FIG. 18, a rectangular opening may be formed in a portion of the sub-tray 32 corresponding to the trailing edge restriction member 33. Then, the trailing edge restriction member 33 may be turned to stand on the contained-state upper surface 37 of the sub-tray 32 and the upper surface of the downstream stacking portion 34. In this case, the first restriction surface 40 of the trailing edge restriction member 33 faces the downstream side of the sheet feed direction (the apparatus main body 2 side), and the first restriction surface 40 functions as a trailing edge restriction surface of the trailing edge restriction member 33. An exemplary method for standing the trailing edge restriction member 33 on the upper surface of the sub-tray 32 is as follows. When the sub-tray 32 is turned by approximately 180° from the contained state (into the extended state), the trailing edge restriction member 33 is turned by approximately 270° from the contained state. While keeping this state, the sub-tray 32 is returned to the contained state.

In the recording sheet stacking tray according to the embodiment, the sub-tray may include a first sub-tray and a second sub-tray slidable relative to the first sub-tray in the sheet feed direction.

In the recording sheet stacking tray according to the embodiment, the sub-tray may include a second turning fulcrum extending perpendicular to the sheet feed direction of the recording sheets in a plan view, and the trailing edge restriction member may be attached to the sub-tray in such a manner that the trailing edge restriction member is turnable about the second turning fulcrum and extendable from the sub-tray.

In the recording sheet stacking tray according to the embodiment, when recording sheets of a predetermined size in use are stacked on the recording sheet stacking tray, the first turning fulcrum may be located away from a position of trailing edges of the recording sheets.

In the recording sheet stacking tray according to the embodiment, protrusions may be formed on the trailing edge restriction member, and insertion holes corresponding to the protrusions may be formed in an upper surface of the sheet feed tray main body.

In the recording sheet stacking tray according to the embodiment, a portion of the trailing edge restriction member in contact with the trailing edges of the recording sheets in the sheet feed direction may include an elastic member.

In the recording sheet stacking tray according to the embodiment, the trailing edge restriction member may be slidable relative to the sub-tray in the sheet feed direction.

According to the embodiment of the present invention, the sub-tray and the trailing edge restriction member attached to the sub-tray are arranged to be turnable about the first turning fulcrum of the sheet feed tray main body. With the simple configuration, the trailing edge restriction member is readily moved to a desired restriction position. Further, the sub-tray to which the trailing edge restriction member is attached is contained in the sheet feed tray main body, which ensures space reduction.

Obviously, numerous modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. A recording sheet stacking tray on which recording sheets to be fed into an image forming apparatus are stacked, the recording sheet stacking tray comprising:

a sheet feed tray main body comprising a first turning fulcrum extending perpendicular to a sheet feed direction of the recording sheets in a plan view;

a sub-tray attached to the sheet feed tray main body such that the sub-tray is turnable about the first turning fulcrum and extendable from the sheet feed tray main body; and a trailing edge restriction member attached to the sub-tray and configured to restrict trailing edges of the recording sheets in the sheet feed direction, wherein:

the sub-tray comprises a first sub-tray which is turnable about the first turning fulcrum, and a second sub-tray which is slidably extendable relative to the first sub-tray in the sheet feed direction, the second sub-tray comprises a second turning fulcrum extending perpendicular to the sheet feed direction of the recording sheets in plan view, and the trailing edge restriction member is attached to the second sub-tray such that the trailing edge restriction member is turnable about the second turning fulcrum and extendable from the second sub-tray, a protrusion is formed on an upper portion of the trailing edge restriction member, and an insertion hole corresponding to the protrusion is formed in an upper surface of the sheet feed tray main body at a position downstream of the first turning fulcrum in the sheet feed direction, the first sub-tray is turnable about the first turning fulcrum to be in at least one of (i) a first state in which an end of the second sub-tray at which the trailing edge restriction member is attached is positioned upstream of the first turning fulcrum in the sheet feed direction, and (ii) a second state in which the end of the second sub-tray at which the trailing edge restriction member is attached is positioned downstream of the first turning fulcrum in the sheet feed direction, and when the first sub-tray is turned about the first fulcrum to be in the second state, and the trailing edge restriction member is turned about the second turning fulcrum so as to be extended from the second sub-tray, the protrusion formed on the upper portion of the trailing edge restriction member is engageable with the insertion hole such that a surface of the trailing edge restriction member, which faces upstream in the sheet feed direction when the first sub-tray is turned to be in the first state and the trailing edge restriction member is turned so as to be extended from the second sub-tray, instead faces downstream in the sheet feed direction.

2. The recording sheet stacking tray according to claim 1, wherein when recording sheets of a predetermined size in use are stacked on the recording sheet stacking tray, the first turning fulcrum is located away from a position of trailing edges of the recording sheets.

3. The recording sheet stacking tray according to claim 1, wherein the protrusion comprises a plurality of protrusions formed on the upper portion of the trailing edge restriction member, and wherein the insertion hole comprises a plurality of insertion holes corresponding to the protrusions.

4. The recording sheet stacking tray according to claim 1, wherein a portion of the trailing edge restriction member arranged to be in contact with the trailing edges of the recording sheets in the sheet feed direction comprises an elastic member.

5. The recording sheet stacking tray according to claim 1, wherein the trailing edge restriction member is slidable relative to the second sub-tray in the sheet feed direction.

6. The recording sheet stacking tray according to claim 1, wherein the insertion hole comprises a first insertion hole arranged at a first position in the upper surface of the sheet feed tray main body, and a second insertion hole arranged at a second position in the upper surface of the sheet feed tray main body which is upstream of the first position in the sheet feed direction, wherein the second sub-tray is slidable to at least one of a first position and a second position relative to the first sub-tray, and wherein the protrusion is engageable with the first insertion hole when the second sub-tray is in the first position relative to the first sub-tray and the protrusion is engageable with the second insertion hole when the second sub-tray is in the second position relative to the first sub-tray.

7. The recording sheet stacking tray according to claim 6, wherein the protrusion comprises a plurality of protrusions, the first insertion hole comprises a plurality of first insertion holes corresponding to the plurality of protrusions, and the second insertion hole comprises a plurality of second insertion holes corresponding to the plurality of protrusions.

* * * * *